US006653581B2

(12) United States Patent
Bassi

(10) Patent No.: US 6,653,581 B2
(45) Date of Patent: Nov. 25, 2003

(54) DEVICE FOR CLOSING THE DOOR OF AN ELECTRIC HOUSEHOLD APPLIANCE, IN PARTICULAR A DISHWAHSER

(75) Inventor: Alberto Bassi, Turin (IT)

(73) Assignee: ITW Industrial Components S.R.L., Milan (IT)

( * ) Notice: Subject to any disclaimer, the term of this patent is extended or adjusted under 35 U.S.C. 154(b) by 194 days.

(21) Appl. No.: 09/901,573

(22) Filed: Jul. 11, 2001

(65) Prior Publication Data

US 2002/0056997 A1 May 16, 2002

(30) Foreign Application Priority Data

Jul. 12, 2000 (IT) ..... MI2000A1571

(51) Int. Cl.[7] ..... H01H 27/06
(52) U.S. Cl. ..... 200/61.62; 200/61.7; 200/43.01
(58) Field of Search ..... 200/61.62, 61.64, 200/61.7, 61.73, 61.74, 61.76, 61.79, 43.01, 43.11, 43.13, 43.15, 43.21

(56) References Cited

U.S. PATENT DOCUMENTS 3,924,085 A * 12/1975 Stone ..... 200/61.62
4,186,287 A * 1/1980 Scott ..... 200/61.62
4,776,620 A * 10/1988 Marks et al. ..... 292/228
RE34,396 E * 10/1993 Wollenhaupt ..... 200/50 R

FOREIGN PATENT DOCUMENTS

| | | |
|---|---|---|
| EP | 0727178 | 2/1996 |
| GB | 1464070 | 2/1977 |

* cited by examiner

*Primary Examiner*—Karl D. Easthom
*Assistant Examiner*—K. Lee
(74) *Attorney, Agent, or Firm*—Lowe Hauptman Gidman & Berner LLP

(57) ABSTRACT

A device for closing the door of an electric household appliance, in particular a dishwasher, includes a latch that is fitted in rotary manner to the door to cooperate with a catch fixed to the electric household appliance, and is connected to a switch, acting on a circuit of the electric household appliance, by a control lever cooperating with a contact on the switch. The control lever is hinged directly to a support fitted integrally to the door, and is connected to the latch by an elastic element, which keeps the control lever resting permanently on the contact and activates the switch as soon as the latch begins rotating when the door is opened, thus eliminating any dangerous delay in stoppage of the electric household appliance.

19 Claims, 3 Drawing Sheets

DEVICE FOR CLOSING THE DOOR OF AN ELECTRIC HOUSEHOLD APPLIANCE, IN PARTICULAR A DISHWAHSER

The present invention relates to a device for closing the door of an electric household appliance, in particular a dishwasher, and of the type controlling a switch controlling operation of the device.

BACKGROUND OF THE INVENTION

Dishwasher doors, as described for example in British Patent n. 1464070, are known to comprise a rotary latch loaded by a return spring and which, when the door is closed, engages a catch integral with the appliance body, and, when the user pulls on the door by means of a handle, rotates about its hinge to release the catch. To stop the dishwasher (in particular, the water pump) automatically when the door is opened, and so prevent injury to the user, British Patent n. 1464070 features an independent control lever, which must be activated by the user to gain access to the door handle, and which acts on a switch in the circuit powering the dishwasher pump. To be opened, the door calls for the user employing both hands, and, though effective in terms of user safety, is obviously awkward to use. A more straightforward, easy-to-use device ensuring the same degree of safety is therefore desirable.

Devices are also known in which the latch is connected directly to the control lever cooperating with the switch acting on the dishwasher supply circuit; and, when the door is opened, rotation of the latch also moves the control lever which acts on the switch. Known devices of this type, however, have a serious drawback: the direct connection between the latch and the control lever is such that the action of the control lever on the switch is delayed with respect to the movement of the latch, so that the dishwasher is stopped when the door has already started to open, thus endangering the user. Whereas it would be more desirable to cut off the circuit as soon as the door starts to open. This problem is partly solved in European patent Application EP-A-0727178, but only at the expense of a relatively complex mechanism which is difficult to produce and assemble.

SUMMARY OF THE INVENTION

It is an object of the present invention to provide a device for closing the door of an electric household appliance, and designed to eliminate the aforementioned drawbacks of known devices. In particular, it is an object of the invention to provide a device which ensures a high degree of user safety, while at the same time being easy to use and cheap and easy to produce.

The present invention therefore related to a device for closing the door of an electric household appliance in particular a dishwasher.

The device according to the invention is fully effective in ensuring the safety of the user, while at the same time being easy to use and cheap and easy to produce. In particular, the actuating means act immediately on the switch controlling operation of the dishwasher, as soon as the latch begins to release the catch.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 1:
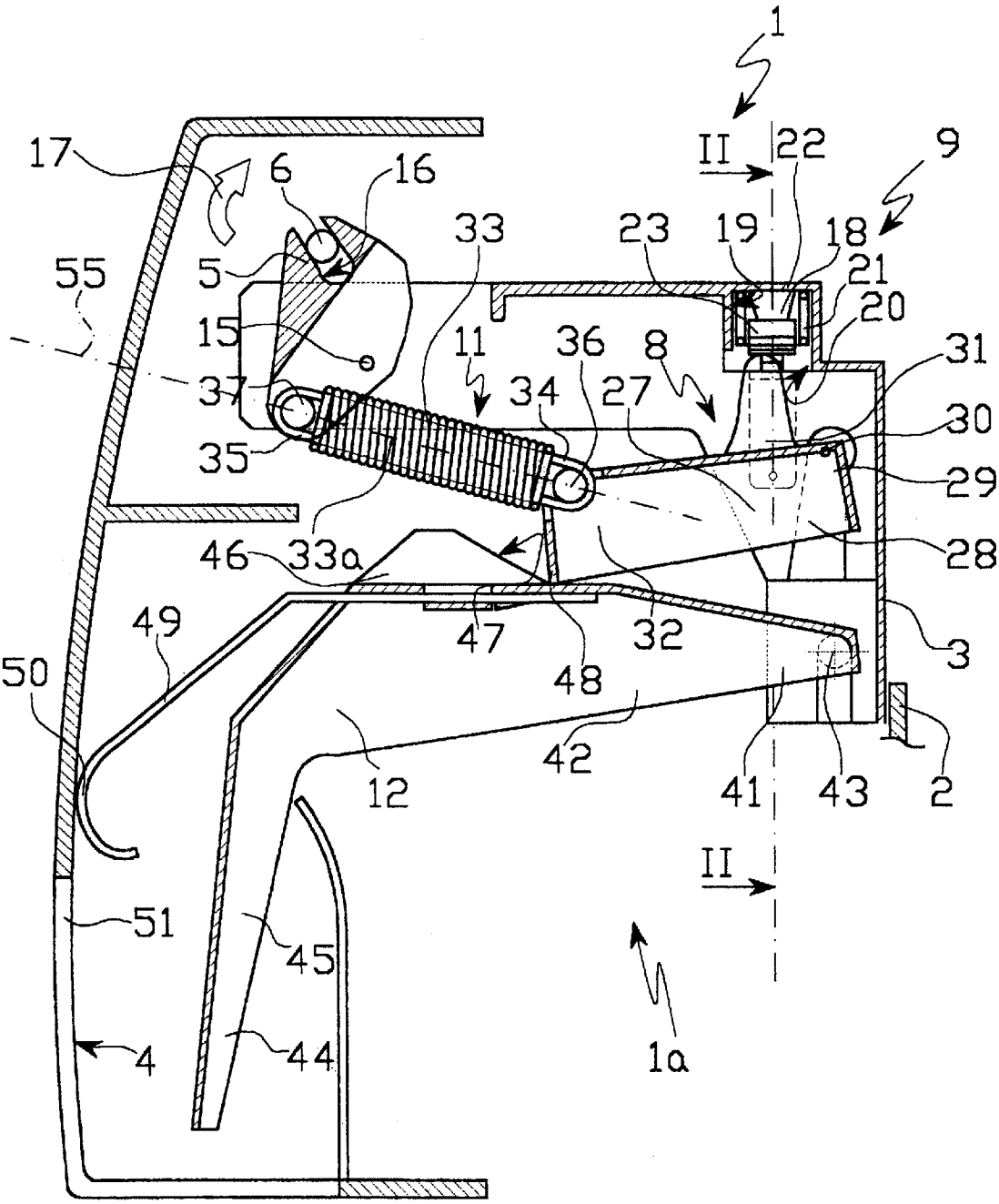
FIG. 1 shows a schematic section of a device for closing the door of an electric household appliance in accordance with the invention and shown in a work position corresponding to the closed-door condition.
Figure 2:
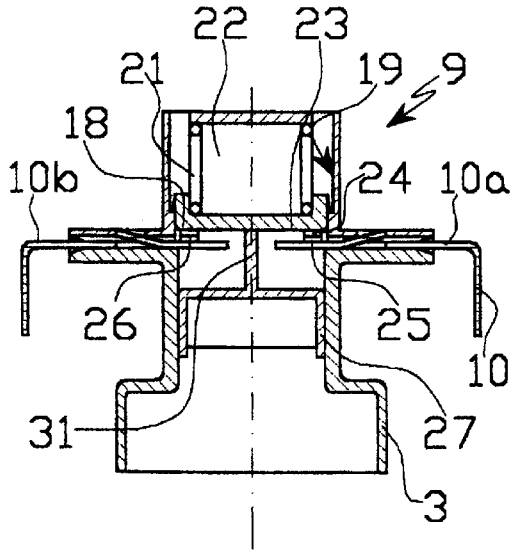
FIG. 2 shows a section along line II—II in FIG. 1.

With reference to FIGS. 1 and 2, number 1 indicates as a whole a device for closing the door 2 of an electric household appliance, in particular a dishwasher. Door 2—known and not described or shown in detail for the sake of simplicity—has a support 3 for device 1. Support 3 is connected integrally (in known manner not shown) to door 2, and comprises a recessed grip seat 4 accessible by the user when support 3 is fitted to door 2. Device 1 comprises a movable latch 5 fitted to support 3 (and therefore integral with door 2) to cooperate with a catch 6 fixed to the appliance body (known and not shown for the sake of simplicity); actuating means 8 cooperating with a switch 9 acting on a circuit 10 of the appliance (e.g. a known pump power circuit); mechanical connecting means 11 for mechanically connecting actuating means 8 and latch 5; and a handle 12 housed inside grip seat 4 and which is gripped by the user.

Latch 5 is defined by a rigid contoured body made, for example, of plastic and hinged to support 3 in known manner (e.g. by means of a pin not shown for the sake of simplicity) at a pivot 15, comprises a seat 16 for engaging catch 6, and rotates in the direction of arrow 17 in FIG. 1 to release catch 6 and open door 2 as explained later on.

Switch 9 is of substantially known type and inserted between two branches 10*a*, 10*b* of circuit 10. More specifically, switch 9 comprises a contact 18 sliding inside a chamber 19 formed in support 3 and having an access opening 20. Contact 18 is loaded by a spring 21 interposed between an end wall 22 of chamber 19 and a head 23 of contact 18, and supports respective silver-plated pads 24 for connecting respective terminals 25, 26 of the two branches 10*a*, 10*b*.

Means 8 for actuating switch 9 comprise a control lever 27 defined, in the example shown, by a rigid box body 28, and hinged at a first end 29 to support 3 (and therefore to door 2) in known manner, e.g. by means of a transverse pin 30 shown only schematically in FIG. 1 and defining a pivot about which control lever 27 rotates with respect to support 3. Control lever 27 comprises a projection 31, which projects perpendicularly from a surface of control lever 27 in an intermediate position between first end 29 and a second end 32, opposite first end 29, of control lever 27, and is housed through opening 20 to rest on head 23 of contact 18.

Mechanical connecting means 11 comprise an elastic element 33 hinged at opposite ends to latch 5 and to control lever 27. In the example shown, elastic element 33 is a helical spring, the longitudinal ends of which are shaped to form respective eyelets 34, 35, which are engaged by respective pins 36, 37 carried by second end 32 of control lever 27 and latch 5 respectively, and defining respective pivots between elastic element 33 and control lever 27 and latch 5. Pin 37 is located on latch 5 on the opposite side of pivot 15 to seat 16. Elastic element 33 is the only direct mechanical connection between latch 5 and control lever 27, and opposes rotation of latch 5 in the direction of arrow 17.

Handle 12, which is of known type, is defined by a substantially L-shaped lever, a first end 41 of a first arm 42 of which is hinged to support 3 at a pivot 43. Handle 12 rotates in the same plane as control lever 27 and latch 5 (i.e. the FIGS. 1 and 3 plane). A second end 44 of handle 12, opposite first end 41 and of a second arm 45 of the L-shaped lever, extends inside grip seat 4 for gripping by the user. Handle 12 comprises a ledge portion 46 defined, in the example shown, by a projection projecting perpendicularly from a surface of first arm 42, on the opposite side to second arm 45. Ledge portion 46 has an inclined surface 47, which cooperates with an end edge 48 of second end 32 of control lever 27 to rotate control lever 27 with respect to pivot 30. Handle 12 is loaded by a return spring 49 defined, for example, by a metal blade fixed to and projecting from first arm 42, on the opposite side to pivot 43, and having a bent portion 50 forced against and cooperating with a wall 51 of grip seat 4.

Device 1 operates as follows.

When the door is closed, device 1 as a whole is set to a first stable equilibrium position 1*a* (FIG. 1) in which latch 5 engages catch 6 and is held in position by elastic element 33, which is set to a first minimum-energy work position 33*a* stretched between latch 5 and control lever 27; a longitudinal axis 55, joining pins 36 and 37, of elastic element 33 is located entirely on the opposite side of pivot 15 to seat 16; end edge 48 of control lever 27 is held by elastic element 33 against first arm 42 of handle 12, substantially at the point where inclined surface 47 joins first arm 42; handle 12 is maintained in the FIG. 1 position by return spring 49; and switch 9 is in the closed position, shown in the FIG. 2 detail, closing circuit 10 to connect branches 10*a* and 10*b*.

Figure 3:
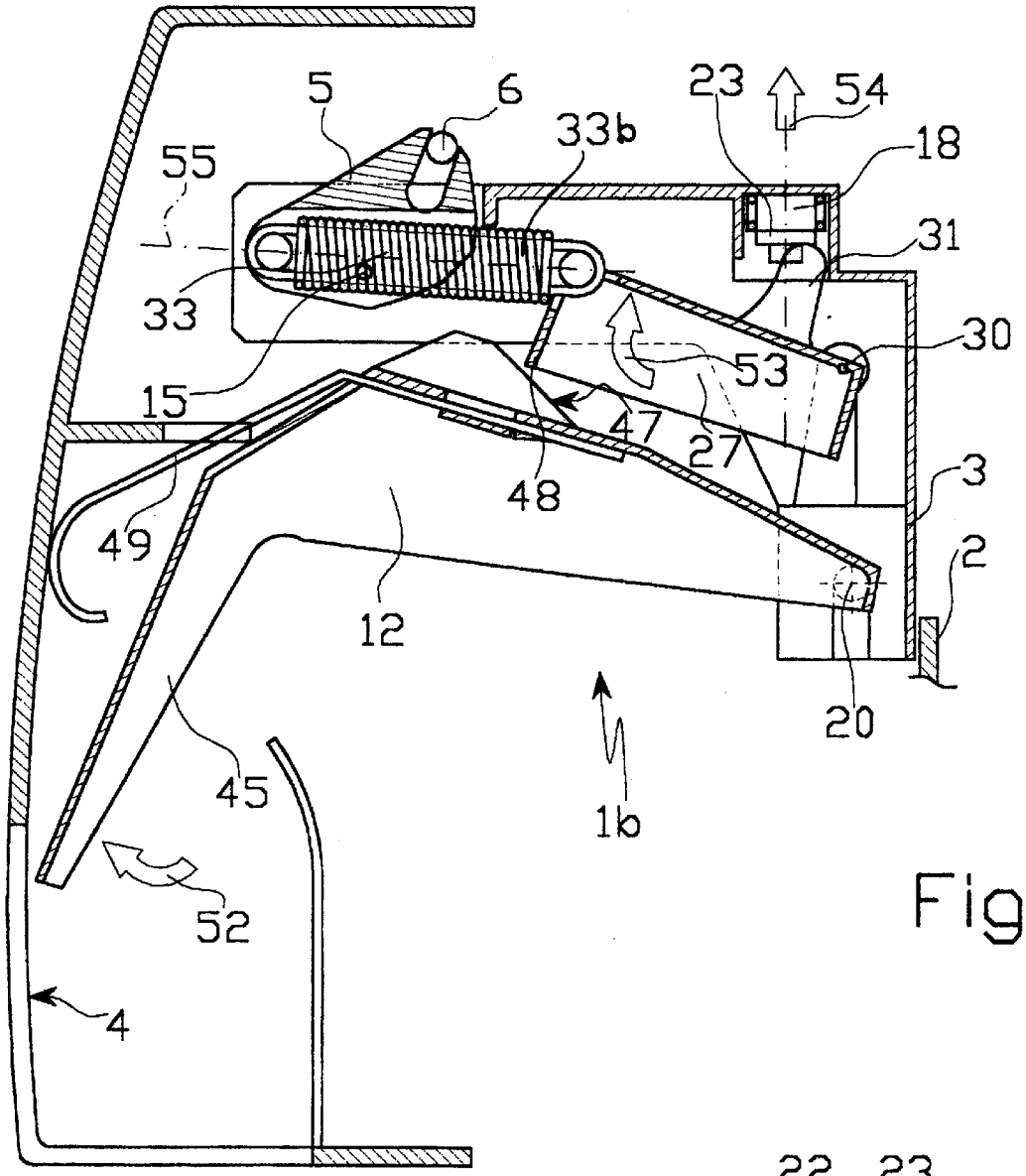
FIG. 3 shows the FIG. 1 device in a work position corresponding to the open-door condition.

When door 2 is opened, device 1 as a whole is set to a second stable equilibrium position 1*b* shown in FIG. 3. To open door 2, the user pulls door 2 using second arm 45 of handle 12, which rotates in the direction of arrow 52 about pivot 43 and in opposition to return spring 49; the rotation of handle 12 causes end edge 48 of control lever 27 to slide along inclined surface 47 and so rotate control lever 27 about pivot 30 in the direction of arrow 53; as soon as control lever 27 begins rotating, projection 31, which is maintained permanently contacting head 23 of contact 18, pushes contact 18 in the direction of arrow 54 to detach pads 24 from respective terminals 25, 26 and so cut off circuit 10 and immediately stop the appliance. At the same time, the rotation of control lever 27 reduces the pull exerted by elastic element 33 on latch 5, and therefor the opposition of elastic element 33 to rotation of latch 5 and the effort required of the user to open door 2; when door 2 is pulled towards the user by means of handle 12, latch 5 is rotated (and releases catch 6) so that control lever 27 is rotated further by elastic element 33, which is set to a second minimum-energy work position 33*b* in which axis 55 is located entirely on the same side of pivot 15 as seat 16.

In one variation (not shown but by now apparent to anyone skilled in the art) particularly suitable for recessed electric household appliances, handle 12 is dispensed with, but latch 5 is still rotated to release catch 6 by the user pulling door 2 open (e.g. by means of grip seat 4); as soon as latch 5 begins rotating (in opposition to elastic element 33), elastic element 33, drawn by the rotation of latch 5, simultaneously rotates control lever 27, 50 that projection 31 acts on contact 18 to stop the appliance immediately.

Figure 4:
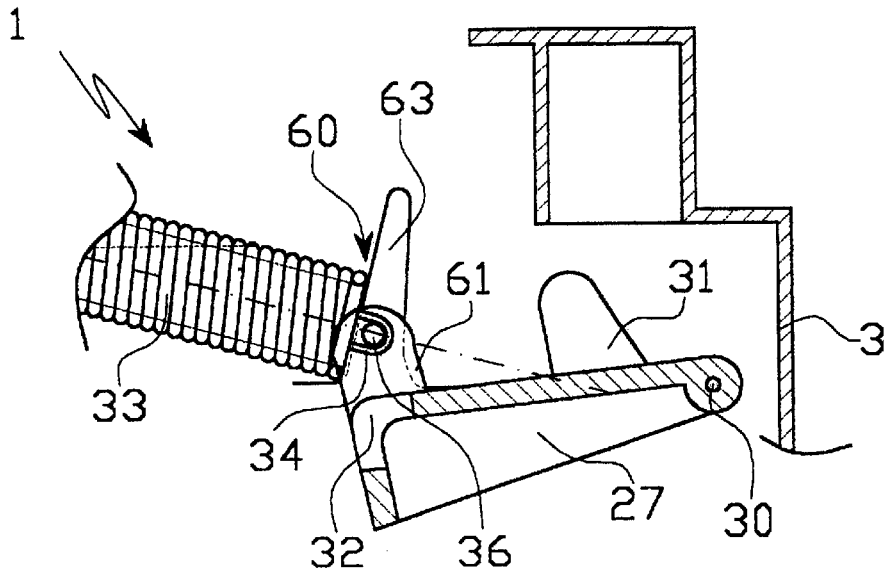
FIG. 4 shows a schematic section, with parts removed for clarity, of a variation of the FIG. 1 device.
Figure 5:
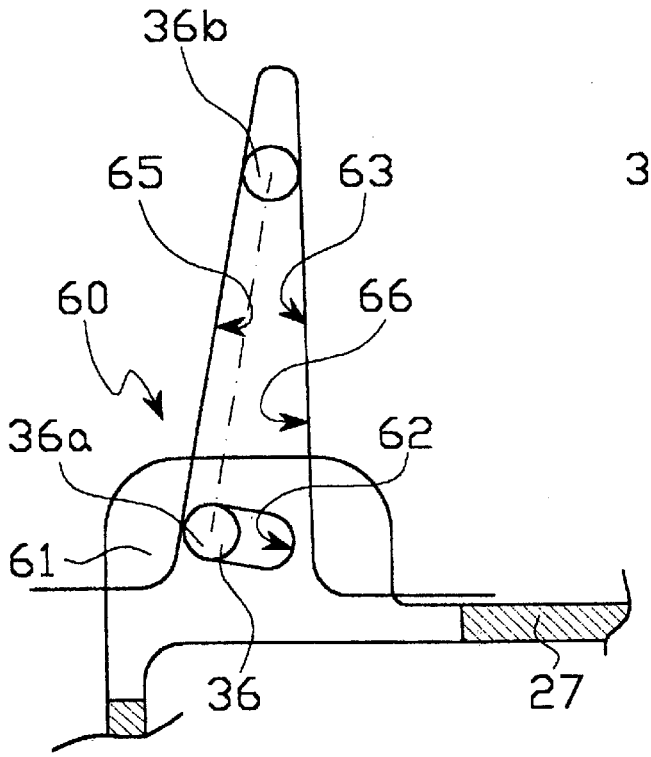
FIGS. 5 and 6 show two schematic views, perpendicular to each other, of a larger-scale detail of the FIG. 4 device.
Figure 6:
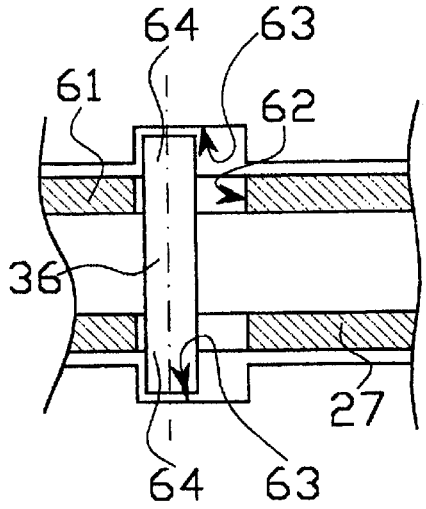

FIGS. 4 to 6, in which any details similar to or identical with those already described are indicated using the same numbering system, show schematically a further variation of the device according to the invention, which is similar in all respects to device 1 already described, but also comprises guide means 60 for guiding hinge pin 36, between elastic element 33 and control lever 27, along a predetermined path other than the arced trajectory along which pin 36 would otherwise travel when control lever 27 is rotated about pivot 30. For which purpose, control lever 27 is provided with two parallel lugs 61, which extend from end 32 of control lever 27, in the same direction as projection 31, and have respective through slots 62 in which pin 36 engaging eyelet 34 of elastic element 33 is inserted freely. Support 3 comprises two facing guides 63 shown only schematically in FIGS. 4 to 6, and inside which slide respective opposite ends 64 of pin 36. Each guide 63 has a substantially straight axis, is roughly triangular, and is defined by converging sides 65, 66 facing latch 5 and control lever 27 respectively. Slots 62 and guides 63 define said guide means 60, which provide for moving pin 36—during operation of device 1 and, in particular, during rotation of control lever 27—along a substantially straight path (FIG. 5) between a closed-door position 36*a* and an open-door position 36*b*, as opposed to an arc produced by the rotation of control lever 27 about pivot 30. Elastic element 33, in fact, which is stretched between latch 5 and control lever 27, holds pin 36 resting against sides 65 of guides 63. When the user opens the door, latch 5 rotates, taking elastic element 33 with it, thus rotating control lever 27, as described previously. In this case, however, pin 36 is not forced to follow the rotation of control lever 27, by slots 62 allowing pin 36 (and therefore elastic element 33) addition travel, which further reduces the energy of elastic element 33 in the minimum-energy work positions 33*a*, 33*b* described previously.

Clearly, changes may be made to the device as described and illustrated herein without, however, departing from the scope of the present invention.

What is claimed is:

1. A device for locking a door of an electric household appliance, said device comprising:

a support adapted to be fitted to said door;

a movable locking element carried by said support and adapted to engage a matching locking element carried by a body of said electric household appliance;

a control lever carried by said support and adapted to operate a switch in a circuit of said electric household appliance; and an elastic element mechanically connecting said control lever and said movable locking element;

wherein said control lever has opposite first and second ends, the first end being hinged to said support and defining a fulcrum of said control lever, and the second end being hinged to said elastic element to define a pivot.

2. A device as claimed in claim 1, wherein said control lever comprises a rigid body; and a projection projecting from said body, in an intermediate position between said first end and said second end of the control lever, so as to rest on said switch.

3. A device as claimed in claim 2, wherein said elastic element is a helical spring having opposite longitudinal ends pivotally attached to said moveable locking element and said control lever, respectively.

4. A device as claimed in claim 3, wherein said moveable locking element is hinged to said support at a hinge, has a seat for engaging the matching locking element of said electric household appliance, and is hinged to said elastic element on the opposite side of said hinge with respect to said seat.

5. A device as claimed in claim 4, further comprising an user-activated handle loaded by a return spring;

said handle being hinged to said support and having a ledge portion cooperating with said control lever.

6. A device as claimed in claim 5, wherein said ledge portion comprises an inclined surface which cooperates with an end edge of said control lever, located at said second end of the control lever, to rotate said control lever with respect to said fulcrum.

7. A device as claimed in claim 1, further comprising guide means for guiding said pivot along a predetermined path other than the arced trajectory produced by rotation of said control lever about said fulcrum.

8. A device for locking a door of an electric appliance, said device comprising:

a support adapted to be fixed to said door;

a movable locking element carried by said support and adapted to engage a matching locking element carried by a body of said electric appliance;

a control lever carried by said support and adapted to operate a switch in a circuit of said electric appliance; and an elastic element connecting said control lever and said movable locking element;

wherein said control lever has opposite first and second end portions, the first end portion being pivotally attached to said support and defining a fulcrum of said control lever, and the second end portion being pivotally attached to said elastic element by a pivot pin; and said elastic element is pivotally attached to said movable locking element.

9. A device as claimed in claim 8, further comprising said switch adapted to cut off the circuit of said electric appliance, wherein said control lever comprises a projection positioned in an intermediate position between said first and second end portions and permanently resting on said switch.

10. A device as claimed in claim 8, wherein said elastic element is a spring having opposite longitudinal ends pivotally attached to said moveable locking element and the second end portion of said control lever, respectively.

11. A device as claimed in claim 10, wherein said moveable locking element is hinged to said support at a hinge and has a seat for engaging the matching locking element of said electric appliance.

12. A device as claimed in claim 11, wherein said device has first and second stable equilibrium positions corresponding to closed and open state of said switch, respectively;

in the first stable equilibrium position, the hinge and the seat are located on the same side with respect to an axis defined by the opposite longitudinal ends of said spring; and in the second stable equilibrium position, the hinge and the seat are located on opposite sides with respect to said axis.

13. A device as claimed in claim 12, wherein a biasing force exerted by said spring on said moveable locking element in the second stable equilibrium position is less than in the first stable equilibrium position.

14. A device as claimed in claim 8, wherein said moveable locking element is hinged to said support at a hinge and has a seat for engaging the matching locking element of said electric appliance;

said elastic element biasing said moveable locking element into a locked position where the matching locking element of said electric appliance is received in said seat.

15. A device as claimed in claim 8, further comprising an user-activated handle and a return spring biasing the handle into a normal position;

said handle being hinged to said support and having a ledge portion acting on said control lever when said handle pivots from the normal position.

16. A device as claimed in claim 15, wherein said ledge portion comprises an inclined surface which acts on said second end portion of the control lever to rotate said control lever with respect to said fulcrum.

17. A device as claimed in claim 8, wherein said pivot pin is moveable within a slot formed in the second end portion of said control lever; and said support comprises a guide element defining for said pivot pin a travel path other than the arced trajectory produced by the second end portion when said control lever rotates about said fulcrum.

18. A device as claimed in claim 17, wherein said travel path is straight.

19. A device as claimed in claim 8, wherein said moveable locking element is a latch adapted to engage a matching catch carried by a body of said electric appliance.

* * * * *